US005397769A

United States Patent [19]

Higaki et al.

[11] Patent Number: 5,397,769

[45] Date of Patent: Mar. 14, 1995

[54] MICROWAVE RESONATOR OF COMPOUND OXIDE SUPERCONDUCTOR MATERIAL HAVING A TEMPERATURE ADJUSTABLE HEATER

[75] Inventors: Kenjiro Higaki; Akihiro Moto; Hideo Itozaki, Hyogo, all of Japan

[73] Assignee: Sumitomo Electric Industries, Ltd., Osaka, Japan

[21] Appl. No.: 890,136

[22] Filed: May 29, 1992

[30] Foreign Application Priority Data

May 29, 1991 [JP] Japan ..... 3-153970

[51] Int. Cl.[6] ..... H01P 7/08; H01B 12/02

[52] U.S. Cl. ..... 505/210; 505/701; 505/866; 333/235; 333/99 S

[58] Field of Search ..... 333/235, 234, 219, 205, 333/99 S; 505/1, 700, 701, 866, 204, 210

[56] References Cited

U.S. PATENT DOCUMENTS 4,876,239 10/1989 Cachier ..... 505/866 X 5,208,213 5/1993 Ruby ..... 505/866 X

FOREIGN PATENT DOCUMENTS 189206 7/1989 Japan ..... 333/219.1

190001 7/1989 Japan ..... 333/204

101801 4/1990 Japan ..... 333/204

4068909 3/1992 Japan ..... 333/193

*Primary Examiner*—Benny T. Lee

*Attorney, Agent, or Firm*—Foley & Lardner

[57] ABSTRACT

A microwave resonator includes a superconducting signal conductor formed on a first dielectric substrate, and a superconducting ground conductor formed on a second dielectric substrate. The first dielectric substrate is stacked on the superconducting ground conductor of the second dielectric substrate. A temperature adjustable heater is mounted near to the second dielectric substrate, so that the resonating frequency $f_o$ of the microwave resonator can be easily adjusted by controlling the temperature of the superconducting conductors by the adjustable heater.

11 Claims, 3 Drawing Sheets

MICROWAVE RESONATOR OF COMPOUND OXIDE SUPERCONDUCTOR MATERIAL HAVING A TEMPERATURE ADJUSTABLE HEATER

BACKGROUND OF THE INVENTION

1. Field of the Invention

The present invention relates to microwave resonators, and particularly to a novel structure of microwave resonators which have a signal conductor formed of a compound oxide superconducting thin film.

2. Description of Related Art

Electromagnetic waves called "microwaves" or "millimetric waves" having a wavelength in a range of tens of centimeters to a few millimeters can be theoretically said to be merely a part of an electromagnetic wave spectrum, but in many cases, have been considered in the electric engineering field to be a special independent field of the electromagnetic wave, since special and unique methods and devices have been developed for handling these electromagnetic waves.

In 1986, Bednorz and Müller reported $(La, Ba)_2CuO_4$ showing a superconduction state at a temperature of 30 K. In 1987, Chu reported $YBa_2Cu_3O_y$ having a superconduction critical temperature on the order of 90 K., and in 1988, Maeda reported a so-call bismuth (Bi) type compound oxide superconductor material having a superconduction critical temperature exceeding 100 K. These compound oxide superconductor materials can obtain a superconduction condition with cooling using inexpensive liquid nitrogen. As a result, the possibility of actual application of superconduction technology has been discussed and studied.

Phenomenon inherent to the superconduction can be advantageously utilized in various applications, and the microwave component is no exception. In general, a microstrip line has an attenuation coefficient that is attributable to a resistance component of the conductor. This attenuation coefficient attributable to the resistance component increases in proportion to a root of a frequency. On the other hand, the dielectric loss increases in proportion to increase of the frequency. However, the loss in a recent microstrip line is almost entirely attributable to the resistance of the conductor in a frequency region not greater than 10 GHz, since the dielectric materials have been improved. Therefore, if the resistance of the conductor in the strip line can be reduced, it is possible to greatly enhance the performance of the microstrip line.

As is well known, the microstrip line can be used as a simple signal transmission line. In addition, if a suitable patterning is applied, the microstrip line can be used as microwave components including an inductor, a filter, a resonator, a delay line, etc. Accordingly, improvement of the microstrip line will lead to improvement of characteristics of the microwave component. Therefore, various microwave components having a signal conductor formed of an oxide superconductor have been proposed.

A typical conventional microwave resonator using the oxide superconductor as mentioned above includes a first substrate provided with a superconducting signal conductor formed of an oxide superconducting thin film patterned in a predetermined shape, and a second substrate having a whole surface provided with a superconducting ground conductor also formed of an oxide superconducting thin film. The first and second substrates are stacked on each other within a metal package, which is encapsulated and sealed with a metal cover.

The superconducting signal conductor is composed of a resonating superconducting signal conductor, and a pair of superconducting signal launching conductors, located at opposite sides of the resonating superconducting signal conductor, separated from the resonating superconducting signal conductors. These superconducting signal conductor and the superconducting ground conductor can be formed of an superconducting thin film of, for example, an Y-Ba-Cu-O type compound oxide.

The microwave resonator having the above mentioned construction has a specific resonating frequency $f_o$ in accordance with the characteristics of the superconducting signal conductor, and can be used for frequency control in a local oscillator of microwave communication instruments, and for other purposes.

However, one problem has been encountered in which the resonating frequency $f_o$ of the microwave resonator actually manufactured by using the oxide superconductor is not necessarily consistent with a designed value. Namely, in this type microwave resonator, a slight variation in characteristics of the oxide superconducting thin film and a slight error in assembly both cause an inevitable dispersion in the characteristics of the microwave resonator.

SUMMARY OF THE INVENTION

Accordingly, it is an object of the present invention to provide a microwave resonator which has overcome the above mentioned defects of a conventional resonator.

Another object of the present invention is to provide a novel microwave resonator which can easily adjust the characteristics of the microwave resonator in order to compensate for the dispersion in the characteristics of the microwave resonator.

The above and other objects of the present invention are achieved in accordance with the present invention by a microwave resonator including a dielectric substrate, a patterned superconducting signal conductor provided at one surface of the dielectric substrate and a superconducting ground conductor provided at the other surface of the dielectric substrate, the superconducting signal conductor and the superconducting ground conductor being formed of an oxide superconducting thin film, the resonator further including a temperature adjustable heater located near the superconducting signal conductor and the superconducting ground conductor so as to heat the superconducting signal conductor and the superconducting ground conductor.

As seen from the above, the microwave resonator in accordance with the present invention is characterized in that it has the means for adjusting its resonating frequency $f_o$, and the adjustment of the resonating frequency $f_o$ can be controlled in an electrical manner.

It has been known that the oxide superconductor has various unique characteristics different from conventional metal superconductors. The microwave resonator in accordance with the present invention utilizes one of the unique characteristics of the oxide superconductor.

Namely, the oxide superconductor has a property that in a temperature region not higher than a critical temperature where the oxide superconductor begins to behave as a superconductor, a ratio of a superconducting electron density $n_s$ to normal conducting electron density $n_n$ will change in response to change of temperature. Therefore, since the magnetic field penetration depth λ of the superconductor will change with the change of temperature, the microwave resonator composed of the oxide superconductor has a temperature dependency characteristics of the resonating frequency in the temperature region not higher than the critical temperature.

In view of this property, the microwave resonator in accordance with the present invention has the electrically controllable heater located near to the resonating conductors, so as to precisely control the temperature of the microwave resonator in order to set the resonating frequency $f_o$ to a desired arbitrary value.

In other words, the microwave resonator in accordance with the present invention is configured such that the resonating frequency $f_o$ can be electrically controlled by adjusting the electric power supplied to the heater.

The superconducting signal conductor layer and the superconducting ground conductor layer of the microwave resonator in accordance with the present invention can be formed of thin films of general oxide superconducting materials such as a high critical temperature (high-Tc) copper-oxide type oxide superconductor material typified by a Y-Ba-Cu-O type compound oxide superconductor material, a Bi-Sr-Ca-Cu-O type compound oxide superconductor material, and a Tl-Ba-Ca-Cu-O type compound oxide superconductor material. In addition, deposition of the oxide superconducting thin film can be exemplified by a technique, a laser evaporation technique, etc.

The substrate can be formed of a material selected from the group consisting of MgO, $SrTiO_3$, $NdGaO_3$, $Y_2O_3$, $LaAlO_3$, $LaGaO_3$, $Al_2O_3$, and $ZrO_2$. However, the material for the substrate is not limited to these materials, and the substrate can be formed of any oxide material which does not diffuse into the high-Tc copper-oxide type oxide superconductor material used, and which substantially matches in crystal lattice with the high-Tc copper-oxide type oxide superconductor material used, so that a clear boundary is formed between the oxide insulator thin film and the superconducting layer of the high-Tc copper-oxide type oxide superconductor material. From this viewpoint, it can be said to be possible to use an oxide insulating material conventionally used for forming a substrate on which a high-Tc copper-oxide type oxide superconductor material is deposited.

A preferred substrate material includes a MgO single crystal, a $SrTiO_3$ single crystal, a $NdGaO_3$ single crystal substrate, a $Y_2O_3$, single crystal substrate, a $LaAlO_3$ single crystal, a $LaGaO_3$ single crystal, a $Al_2O_3$ single crystal, and a $ZrO_2$ single crystal.

For example, the oxide superconductor thin film can be deposited by using, for example, a (100) surface of a MgO single crystal substrate, a (110) surface or (100) surface of a $SrTiO_3$ single crystal substrate and a (001) surface of a $NdGaO_3$ single crystal substrate, as a deposition surface on which the oxide superconductor thin film is deposited.

The above and other objects, features and advantages of the present invention will be apparent from the following description of preferred embodiments of the invention with reference to the accompanying drawings However, the examples explained hereinafter are only for illustration of the present invention, and therefore, it should be understood that the present invention is in no way limited to the following examples.

DESCRIPTION OF THE PREFERRED EMBODIMENTS

Figure 1:
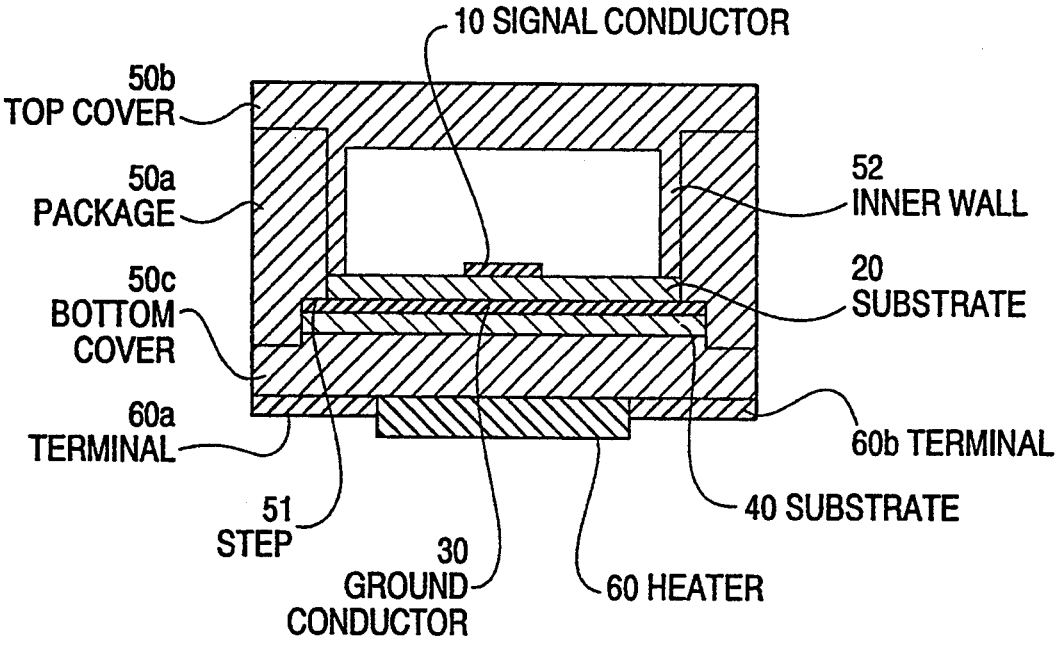
FIG. 1 is a diagrammatic sectional view showing a first embodiment of the microwave resonator in accordance with the present invention.

Referring to FIG. 1, there is shown a diagrammatic sectional view showing a first embodiment of the microwave resonator in accordance with the present invention.

The shown microwave resonator includes a first substrate 20 formed of a dielectric material and having an upper surface formed with a superconducting signal conductor 10 constituted of an oxide superconducting thin film patterned in a predetermined shape mentioned hereinafter, and a second substrate 40 formed of a dielectric material and having an upper surface fully covered with a superconducting ground conductor 30 also formed of an oxide superconducting thin film. The first and second substrates 20 and 40 are stacked on each other in such a manner that all the lower surface of the first substrate 20 is in contact with the superconducting ground conductor 30. The stacked assembly of the first and second substrates 20 and 40 is located within a hollow package **50*a* of a square section having upper and lower open ends, which is encapsulated and sealed at its upper and lower ends with a top cover 50*b* and a bottom cover 50*c*, respectively. The second substrate 40 lies on an upper surface of the bottom cover 50*c***.

Since the oxide superconducting thin film 10 is formed on the first substrate 20 and the oxide superconducting thin film 30 is formed on the second substrate 40 independently of the first substrate 20, it is possible to avoid deterioration of the oxide superconducting thin films, which would occur when a pair of oxide superconducting thin films are sequentially deposited on one surface of a substrate and then on the other surface of the same substrate.

As shown in FIG. 1, the second substrate 40 is larger in size than the first substrate 20, and an inner surface of the package **50*a* has a step 51 to comply with the difference in size between the first substrate 20 and the second substrate 40. Thus, the second substrate 40 is sandwiched and fixed between the upper surface of the bottom cover 50*c* and the step 51 of the package 50*a*, in such a manner that the superconducting ground conductor 30 formed on the second substrate 40 is at its periphery in contact with the step 51 of the package 50*a***.

In addition, the top cover **50*b* has an inner wall 52 extending downward along the inner surface of the package 50*a* so as to abut against the upper surface of the first substrate 20, so that the first substrate 20 is forcibly pushed into a close contact with the the superconducting ground conductor 30 on the second substrate 40, and held between the second substrate 40 and a lower end of the inner wall 52 of the top cover 50***b*.

In addition, actually, lead conductors (not shown) are provided to penetrate through the package 50*a* or the cover 50*b* in order to launch microwave into the signal conductor 10.

The shown microwave resonator also includes a heater 60, which is constituted of a resistor mounted on a lower surface of the bottom cover 50*c* of the package 50*a*. The heater 60 has a pair of power supplying terminals 60*a* and 60*b*.

Figure 2:
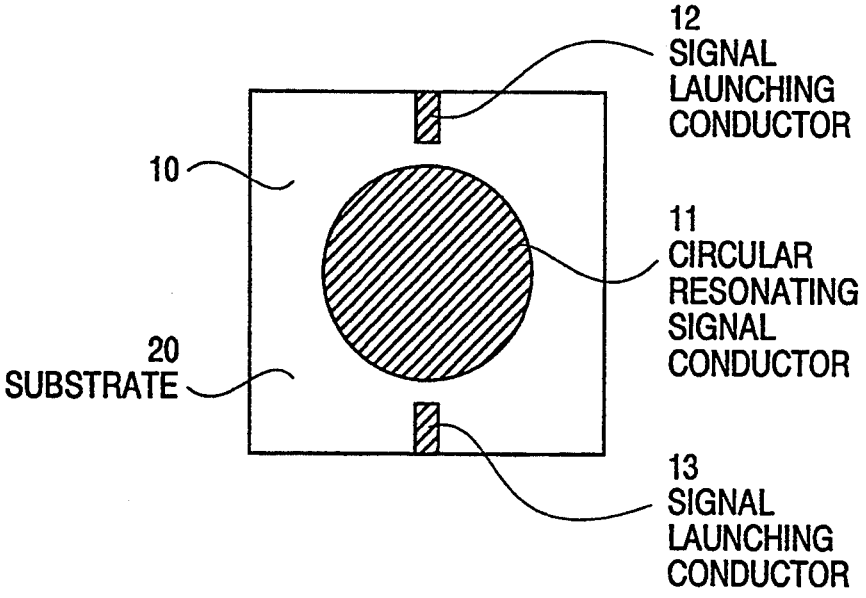
FIG. 2 is a pattern diagram showing the signal conductor of the superconducting microwave resonator shown in FIG. 1.

FIG. 2 shows a pattern of the superconducting signal conductor 10 formed on the first substrate 20 in the microwave resonator shown in FIG. 1.

As shown in FIG. 2, on the first substrate 20 there are formed a circular superconducting signal conductor 11 to constitute a resonator, and a pair of superconducting signal conductors 12 and 13 launching and picking up the microwave to and from the superconducting signal conductor 11. These superconducting signal conductors 11, 12 and 13 and the superconducting ground conductor 30 on the second substrate 40 can be formed of an superconducting thin film of for example an Y-Ba-Cu-O type compound oxide.

The microwave resonator having the above mentioned construction is used by cooling the superconducting signal conductor 10 and the superconductor ground conductor 30 so that the conductors 10 and 30 behave as superconductors, but the temperature can be precisely controlled in a temperature region near to the critical temperature.

In the above mentioned embodiment, the heater 60 is mounted on the lower surface of the cover 50*c* of the package 50*a*. However, the heater can be provided in the inside of the package 50*a*, for example, on an upper surface of the cover 50*c* or on a lower surface of the cover 50*b*, with no problem.

Figure 3:
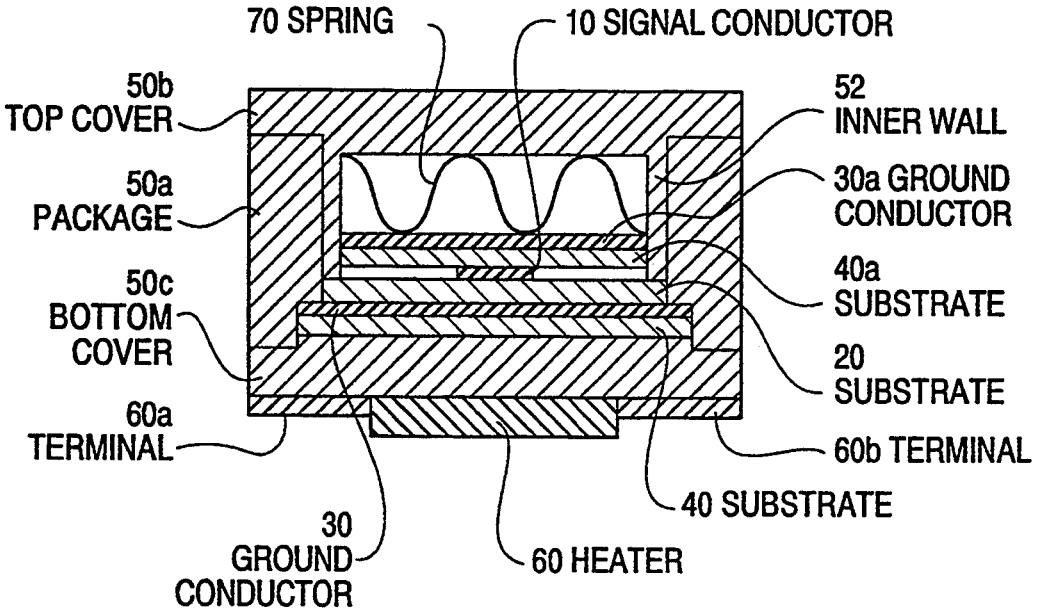
FIG. 3 is a diagrammatic sectional view showing a second embodiment of the microwave resonator in accordance with the present invention.

A microwave resonator having a construction shown in FIG. 3 was actually manufactured.

The microwave resonator shown in FIG. 3 has a construction basically similar to that shown in FIG. 1, but additionally includes a third substrate 40*a* formed with an oxide superconducting thin film which constitutes a second superconducting ground conductor 30*a*. The third substrate 40*a* is formed of a dielectric material, and is stacked on the superconducting signal conductor 10 and is located within the package 50*a*. The third substrate 40*a* is brought into a close contact with the superconducting signal conductor 10 by means of a spring 70.

The first substrate 20 was formed of a square MgO substrate having each side of 18 mm and a thickness of 1 mm. The superconducting signal conductor 10 was formed of a Y-Ba-Cu-O compound oxide thin film having a thickness of 5000Å. This Y-Ba-Cu-O type compound oxide superconducting thin film was deposited by a sputtering. The deposition condition was as follows:

Target: $Y_1Ba_2Cu_3O_y$
Sputtering gas: Ar containing 20 mol % of $O_2$
Gas pressure: 0.5 Torr
Substrate Temperature: 620° C.
Film thickness: 5000 Å

The superconducting signal conductor 10 thus formed was patterned as follows so as to constitute the resonator: The superconducting signal conductor 11, as shown in FIG. 2, is in the form of a circle having a diameter of 12 mm, and the pair of superconducting signal launching conductors 12 and 13 have a width of 0.4 mm and a length of 2.0 mm. A distance or gap between the superconducting signal conductor 11 and each of the superconducting signal launching conductors 12 and 13 is 1.0 mm at the shortest portion.

On the other hand, the second substrate 40 and the third substrate 40*a* were formed of square MgO substrates having a thickness of 1 mm. The second substrate 40 and the third substrate have each side of 20 mm and 18 mm, respectively. The superconducting ground conductors 30 and 30*a* were formed of a Y-Ba-Cu-O compound oxide thin film having a thickness of 5000Å, in a sputtering similar to that for deposition of superconducting signal conductor 10.

The above mentioned three substrates 20, 40, and 40*a* were located within the square-section hollow package 50*a* formed of brass, and opposite openings of the package 50*a* were encapsulated and sealed with the covers 50*b* and 50*c* also formed of brass. In this process, the third substrate 40*a* was brought into a close contact with the superconducting signal conductor 10 by means of a spring 70. Inner wall 52 performs a function similar to the inner wall 52 of FIG. 1.

The lower surface of the cover 50*c* was previously formed through an insulating layer of $SiO_2$ with a nichrome thick film which forms a heater 60. In addition, two nickel layers were coated to form a pair of electrodes, on which a pair of electric power supplying terminals 60*a* and 60*b* for the heater 60 were soldered.

For the superconducting microwave resonator thus formed, a frequency characteristics of the transmission power was measured by use of a network analyzer.

Figure 4:
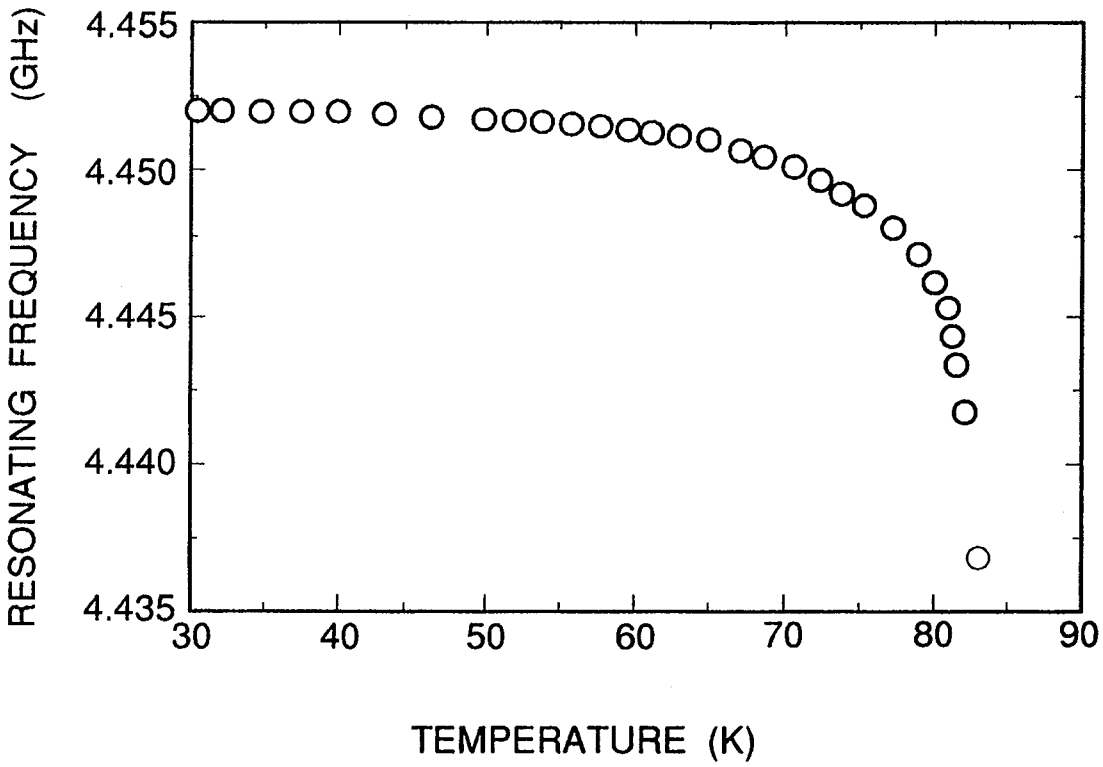
FIG. 4 is a graph showing the characteristics of the superconducting microwave resonator shown in FIG. 3.

Firstly, by locating the microwave resonator in a cryostat without operating the heater 60 provided with the microwave resonator, the temperature characteristics of the resonating frequency was measured. The result of the measurement is shown in FIG. 4.

Furthermore, by operating and controlling the heater while cooling the microwave resonator by a liquid nitrogen, the resonating frequency was measured at temperatures of 77 K., 79 K., and 81 K., respectively. The result of the measurement is as follows:

| | | | |
|---|---|---|---|
| measurement temperature (K) | 77 | 79 | 81 |
| resonating frequency (MHz) | 4448.1 | 4446.5 | 4444.5 |

It will be noted that the resonating frequency lowers with increase of the temperature.

As mentioned above, the microwave resonator in accordance with the present invention is so constructed as to be able to easily adjust the resonating frequency $f_o$. In addition, this adjustment of the resonating frequency $f_o$ can be controlled in an electrical manner from outside of the resonator. Therefore, after the resonator is assembled, the adjustment can be easily performed, and even when the resonator is operating, the adjustment can be easily performed.

Accordingly, the microwave resonator in accordance with the present invention can be effectively used in a local oscillator of microwave communication instruments, and the like.

The invention has thus been shown and described with reference to the specific embodiments. However, it should be noted that the present invention is in no way limited to the details of the illustrated structures but changes and modifications may be made within the scope of the appended claims.

We claim:

1. A microwave resonator comprising:

a first dielectric substrate;

a patterned superconducting signal conductor provided on one surface of said first dielectric substrate and a superconducting ground conductor provided adjacent to an opposite surface of said first dielectric substrate, said superconducting signal conductor and said superconducting ground conductor being respectively comprised of an oxide superconducting thin film; and a temperature adjustable heater located adjacent to said superconducting signal conductor and said superconducting ground conductor so as to provide heat to said superconducting signal conductor and said superconducting ground conductor, so that a resonating frequency $f_o$ of the microwave resonator can be easily adjusted by controlling the temperature of said superconducting signal conductor and said superconducting ground conductor by said temperature adjustable heater.

2. A microwave resonator claimed in claim 1 wherein each of said superconducting signal conductor respectively and said superconducting ground conductor comprises a high critical temperature copper-oxide type oxide superconductor material.

3. A microwave resonator claimed in claim 1 wherein each of said superconducting signal conductor and said superconducting ground conductor is respectively comprised of a material selected from the group consisting of a Y-Ba-Cu-O type compound oxide superconductor material, a Bi-Sr-Ca-Cu-O type compound oxide superconductor material, and a Tl-Ba-Ca-Cu-O type compound oxide superconductor material.

4. A microwave resonator claimed in claim 1 wherein said first dielectric substrate is respectively comprised of a material selected from the group consisting of MgO, $SrTiO_3$, $NdGaO_3$, $Y_2O_3$, $LaAlO_3$, $LaGaO_3$, $Al_2O_3$, and $ZrO_2$.

5. A microwave resonator claimed in claim 1, wherein said superconducting signal conductor is disposed on said one surface of said first dielectric substrate, and said superconducting ground conductor is disposed to completely cover an upper surface of a second dielectric substrate, said first dielectric substrate being stacked on said second dielectric substrate in close contact with said superconducting ground conductor on said second dielectric substrate, and said heater being located adjacent to a lower surface of said second dielectric substrate so as to provide heat to said superconducting signal conductor and said superconducting ground conductor.

6. A microwave resonator comprising:

a first dielectric substrate;

a patterned superconducting signal conductor provided on one surface of said first dielectric substrate;

a superconducting ground conductor provided adjacent to an opposite surface of said first dielectric substrate, said superconducting signal conductor and said superconducting ground conductor being respectively comprised of an oxide superconducting thin film;

a temperature adjustable heater located adjacent to said superconducting signal conductor and said superconducting ground conductor so as to provide heat to said superconducting signal conductor and said superconducting ground conductor, a resonating frequency $f_o$ of the microwave resonator being adjusted by controlling the temperature of said superconducting signal conductor and said superconducting ground conductor by said temperature adjustable heater;

a package having a hollow member having a top opening and a bottom opening;

a top cover fitted to said top opening of said hollow member;

a bottom cover fitted to said bottom opening of said hollow member;

a stacked assembly comprised of said first dielectric substrate and a second dielectric substrate being located within said package in such a manner that a lower surface of said second dielectric substrate is in contact with an inner surface of said bottom cover, and said heater being mounted on said bottom cover; and wherein said superconducting signal conductor is disposed on said one surface of said first dielectric substrate, and said superconducting ground conductor is disposed to completely cover a whole of an upper surface of said second dielectric substrate, said first dielectric substrate being disposed on said second dielectric substrate in close contact with said superconducting ground conductor on said second dielectric substrate.

7. A microwave resonator claimed in claim 6 wherein said heater includes a resistor disposed on an outer surface of said bottom cover.

8. A microwave resonator claimed in claim 6 further including a second superconducting ground conductor disposed so as to cover a whole of an upper surface of a third dielectric substrate, said third dielectric substrate has a lower surface in contact with said superconducting signal conductor of said first dielectric substrate, and a spring located between said top cover and said third dielectric substrate so as to push said third dielectric substrate into contact with said first dielectric substrate.

9. A microwave resonator claimed in claim 6 wherein each of said superconducting signal conductor and said superconducting ground conductor respectively comprises a high critical temperature copper-oxide type oxide superconductor material.

10. A microwave resonator claimed in claim 6 wherein each of said superconducting signal conductor and said superconducting ground conductor is respectively comprised of a material selected from the group consisting of a Y-Ba-Cu-O type compound oxide superconductor material, a Bi-Sr-Ca-Cu-O type compound oxide superconductor material, and a Tl-Ba-Ca-Cu-O type compound oxide superconductor material.

11. A microwave resonator claimed in claim 6 wherein each of said first dielectric substrate and said second dielectric substrate is respectively comprised of a material from the group consisting of MgO, $SrTiO_3$, $NdGaO_3$, $Y_2O_3$, $LaAlO_3$, $LaGaO_3$, $Al_2O_3$, and $ZrO_2$.

* * * * *